US006774589B2

(12) United States Patent
Sato et al.

(10) Patent No.: US 6,774,589 B2
(45) Date of Patent: Aug. 10, 2004

(54) ROCKING SEAT CONTROL APPARATUS

(75) Inventors: Gen Sato, Saitama-ken (JP); Tsutomu Fukasawa, Saitama-ken (JP); Takeshi Kawashima, Kanagawa-ken (JP)

(73) Assignee: Combi Corporation, Tokyo (JP)

( * ) Notice: Subject to any disclaimer, the term of this patent is extended or adjusted under 35 U.S.C. 154(b) by 128 days.

(21) Appl. No.: 10/067,829

(22) Filed: Feb. 8, 2002

(65) Prior Publication Data

US 2002/0140263 A1 Oct. 3, 2002

(30) Foreign Application Priority Data

Feb. 16, 2001 (JP) ..... 2001-039756
May 21, 2001 (JP) ..... 2001-151644

(51) Int. Cl.[7] ..... H02K 33/00; A47D 9/02

(52) U.S. Cl. ..... 318/127; 318/128; 297/260.1; 297/260.2

(58) Field of Search ..... 318/119–134; 297/260.1, 260.2

(56) References Cited

U.S. PATENT DOCUMENTS 5,223,778 A * 6/1993 Svarovsky et al. ..... 318/610
5,245,528 A * 9/1993 Saito et al. ..... 700/41
6,114,798 A * 9/2000 Maruyama et al. .... 310/323.06
6,120,095 A * 9/2000 Rogers ..... 297/273
6,152,529 A * 11/2000 Beason ..... 297/260.2
6,153,952 A * 11/2000 Ito et al. ..... 310/36
6,330,837 B1 * 12/2001 Charles et al. ..... 74/490.06
6,494,850 B1 * 12/2002 Kitadou et al. ..... 601/49

FOREIGN PATENT DOCUMENTS

JP 11-89681 4/1999

* cited by examiner

*Primary Examiner*—Burton S. Mullins
*Assistant Examiner*—Judson H. Jones
(74) *Attorney, Agent, or Firm*—Westerman, Hattori, Daniels & Adrian, LLP

(57) ABSTRACT

A rocking seat control apparatus for a moveable seat supported and having a magnetic member attached thereto is provided that is capable of maintaining the seat being rocked constant in rocking amplitude. The apparatus includes a solenoid for bi-directionally attracting the magnetic member to cause the seat to move in a positive and a negative direction alternately and thereby to be rocked; an amplitude measuring means for measuring an amplitude of the seat being rocked and a rocking motion of the seat; an amplitude damping factor measuring means responsive to displacements in the positive and negative directions of the seat being rocked for measuring an extent of damping factor of the amplitude caused while the seat is being rocked; and a solenoid energizing means for energizing the solenoid means during a time period in which the seat is being rock traveling a distance that is a product of the measured rocking swing and the measured extent of damping factor of amplitude.

A rocking seat control apparatus is also provided that includes a rocking control circuit that computes a 1/f-type fluctuating rocking motion for driving the solenoid so as to rock the seat in a mode of 1/f-type spectrum fluctuation.

9 Claims, 18 Drawing Sheets

ROCKING SEAT CONTROL APPARATUS

BACKGROUND OF THE INVENTION

1. Field of the Invention

The present invention relates to a rocking seat control apparatus, for example, an automatic rocking apparatus for use as an infant chair or bed, or stroller.

2. Description of the Prior Art

The continuing of a seat to sway automatically has been brought to realization in a chair equipped with rocking function as disclosed in JP P H11-89681 A. In the chair described in JP P H11-89681 A, a member composed of magnetic material is attached to a moveable seat supported on the chair. The magnetic member is bi-directionally attracted repetitively towards a solenoid when the latter is periodically energized and magnetized to cause the seat to sway. In the absence of continued attraction by the solenoid, the rocking amplitude of the seat will attenuate and the seat will eventually cease rocking. However, the presence of continued attraction by the solenoid allows the seat to continue to rock.

Also, to vary the amplitude of rocking of the seat controllably, the time duration in which the solenoid is repetitively magnetized can be rendered so that a selected time duration of repetitive magnetization of the solenoid may establish a preselected amplitude of the rocking of the seat.

The variability of the load imposed on the seat with time, however, prevents the amplitude of the rocking of the seat from being kept constant when the solenoid is repetitively magnetized at a selected value in the predetermined time. Also, the prior art has such a drawback that controlling the amplitude of the rocking of the seat preferably entails sensing the instantaneous current position and direction of movement of the seat, which has made it essential to include a large number of sensors in the control apparatus.

BRIEF SUMMARY OF THE INVENTION

The first object of the present invention is accordingly to provide a rocking seat control apparatus that permits a seat to sway and to be rocked at a selected fixed amplitude without regard to the load variation imposed on the seat and that renders the rocking amplitude of the seat readily controllable while sensing an instantaneous current position and a direction of movement of the seat with a reduced number of sensors.

While an automatic rocking chair is thus provided that assures that the chair continues to rock with a fixed amplitude once established by a corresponding preset time duration of the repetitive magnetization of the solenoid, the constancy in amplitude of the rocking over time may make the rocking motion of the seat monotonous. It was shown that when infants seated on monotonously rocking chairs there were wide variations in their reactions.

Accordingly, it is the second object of the present invention to provide a rocking seat control apparatus whereby a seat occupant (infant) may uniformly experience a pleasant feeling and be comforted by imparting a moderate fluctuation to the rocking of the seat.

In order to attain the first object mentioned above, there is provided in accordance with the present invention in a first aspect thereof a rocking seat control apparatus, which comprises: a supported moveable seat having a magnetic member attached thereto; a solenoid means for bi-directionally attracting the said magnetic member repetitively to cause the seat to move in a positive and a negative direction alternately and thereby creating a rocking motion; an amplitude measuring means for measuring an amplitude of the seat being rocked and the rocking motion of the seat; an amplitude damping factor measuring means responsive to displacements in the positive and negative directions of the seat being rocked for measuring the extent of damping of the said amplitude caused while the seat is being rocked; and a solenoid energizing means for energizing the said solenoid means for a time period in which the seat is being rocked during traveling a distance that is the product of the said measured rocking motion and the said measured amplitude of damping factor.

The rocking seat control apparatus constructed as mentioned above, which can be controlled during a time period for which the solenoid means is energized to be controlled by a distance that is a product of the measured rocking motion and the measured amplitude damping factor, is designed to apply an impulse to the seat that compensates for an extent of damping of the rocking amplitude caused while the seat is being rocked, thereby permitting the rocking amplitude of the seat to be kept constant.

In the rocking seat control apparatus mentioned above, the said magnetic member may be comprised of a pair of magnetic sub-members attached to the seat and whose mid point is positioned to be displaced at a predetermined distance apart from the mid point of the said solenoid means.

This arrangement balances the magnetic force between the solenoid means and two magnetic members attached to the seat, where their mid point is positioned to be displaced at the predetermined distance apart from the mid point of the solenoid means by, and enables to rock the seat with a heavy load imposed thereon.

The rocking seat control apparatus mentioned above may further comprises the first light emitter disposed below a path of the seat being rocked; the second light emitter united to the said first light emitter; the first light reflector including a plurality of light reflector plates attached to the seat arranged in a row and spaced apart from one another across a predetermined spacing in the first direction in which the seat is rocked for reflecting light emitted from the said first light emitter; the second light reflector including a plurality of light reflector plates attached to the seat arranged in a row and spaced apart from one another across a predetermined spacing in a second direction parallel to the said first direction for reflecting light emitted from the said second light emitter, the said light reflector plates of the second light reflector being deviated in position from the said light reflector plates of the first light reflector by half the width of each of the said light reflector plates of the first light reflector; the first light receiver mounted united to the said first light emitter for receiving light reflected back from the said first light reflector; the second light receiver mounted united to the said second light emitter for receiving light reflected back from the said second light reflector; a change of rocking direction detecting means responsive to a light receiving pattern of the said first and second light receivers for detecting a turnabout of the seat being rocked; and a seat amplitude measuring means responsive to numbers of light reception signals issued from the said first and second light receivers for measuring an amplitude of the seat.

This arrangement, which requires that the light reflector plates of the first light reflector are deviated in position from the light reflector plates of the second light reflector by half the width of each of the light reflector plates of the first light reflector, allows the rocking amplitude of the seat to be measured in units each of which is as small as half the width of each of the reflector plates of the first reflector. Furthermore, a difference in the light receiving pattern on the time base between the first and second rows of the reflector plates is advantageously used to allow a turnabout of the rocking to be detected in response to the light receiving patterns of the first and second reflectors. Moreover, the arrangement enables the rocking amplitude of the seat to be measured precisely and instantaneously in response to a number of light receiving signals. Thus, it becomes possible to control the rocking amplitude with a minimum number of sensors.

In the rocking seat control apparatus mentioned above, it is advantageous that if the said light reflector plates of first light reflector and those of second light reflector are made equally in width and spacing to each other, the spacing which successive light reflector plates of each of the said first and second light reflectors are spaced apart is equal to the width of each of the reflector plates of the said first and second light reflectors.

In order to achieve the second object mentioned above, the present invention also provides a rocking seat control apparatus, which comprises: a moveable seat supported and having a magnetic member attached thereto; a solenoid means energizable to bi-directionally attract the said magnetic member repetitively, thereby rocking the seat; a drive circuit to control the magnetization of the said solenoid means; and a 1/f spectrum fluctuation computing circuit adapted to compute a target value corresponding to a target rocking motion of the seat being rocked in a mode of 1/f-type spectrum fluctuation and to enter the said target value into the said drive circuit.

This arrangement, which requires the drive circuit to control the solenoid means so as to give rise to a 1/f-type spectrum fluctuating rocking motion issued from a 1/f-type spectrum fluctuation computing circuit, makes the seat rock in a mode of a 1/f-type spectrum fluctuation. As a result, the seat occupant will experience a pleasant feeling and be comforted according to a 1/f-type spectrum fluctuation.

In the rocking seat control apparatus mentioned above, the said 1/f-type spectrum fluctuation computing circuit preferably includes an initial value input means adapted to be entered with the initial values of the said 1/f-type spectrum fluctuation.

This arrangement, which requires the initial values of a 1/f-type spectrum fluctuation to be preset at the initial value input means, permits attaining any fluctuating rocking motion as desired by appropriately presetting the initial values of the 1/f-type spectrum fluctuation.

The rocking seat control apparatus mentioned above, preferably further includes a target rocking motion input means for entering a target value corresponding to a given target rocking motion into the drive circuit of the said solenoid; and a switching means for selectively connecting either one of the said 1/f-type spectrum fluctuation computing circuits and the said target rocking motion input means to the said drive circuit.

This arrangement, which requires a switching means to be provided for selectively connecting either one of the 1/f-type spectrum fluctuation computing circuits and the target rocking motion input means to the said drive circuit of the said solenoid, enables either a seat rocking mode by the 1/f-type spectrum fluctuation computing circuit or a constant amplitude or swing seat rocking mode by the target rocking motion input means to be selectively established as desired.

BRIEF DESCRIPTION OF THE DRAWINGS

The present invention will be better understood from the following detailed description and drawings attached hereto showing certain illustrative forms of the embodiments of the present invention. In this connection, it should be noted that such forms of the embodiments illustrated in the accompanying drawings hereof are intended in no way to limit the present invention but to facilitate an explanation and an understanding thereof.

In the accompanying drawings:

FIG. 5 illustratively compares the rocking principles in a rocking seat control apparatus according to the present invention shown in FIG. 5(*b*) with the rocking principle in the prior art shown in FIG. 5(*a*), and shown graphically in FIG. 5(*c*) is a difference in impulse between the prior art and the present invention.

DETAILED DESCRIPTION

Figure 1:
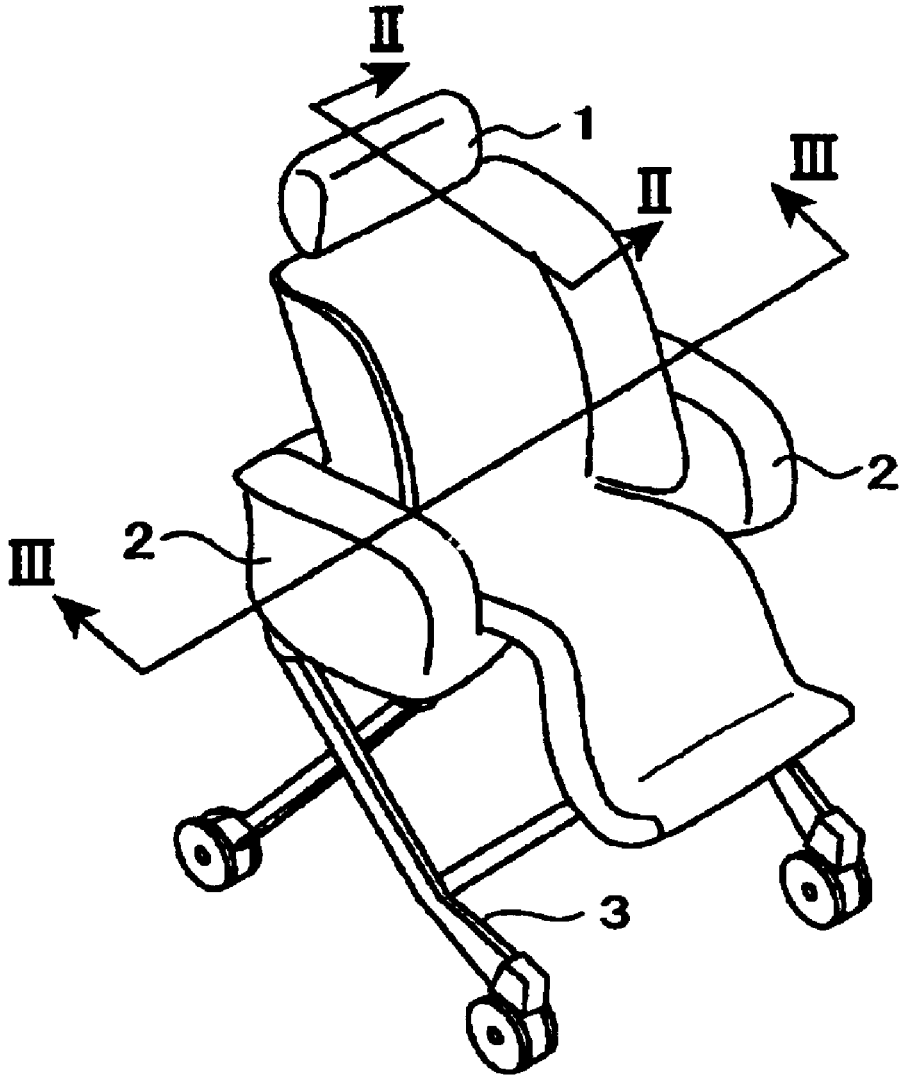
FIG. 1 is an overall perspective view illustrating an exemplary chair that incorporates a rocking seat control apparatus according to the present invention.

Referring now to the drawing Figures, an explanation is given in respect of representative forms of implementation of the present invention.

Figure 2:
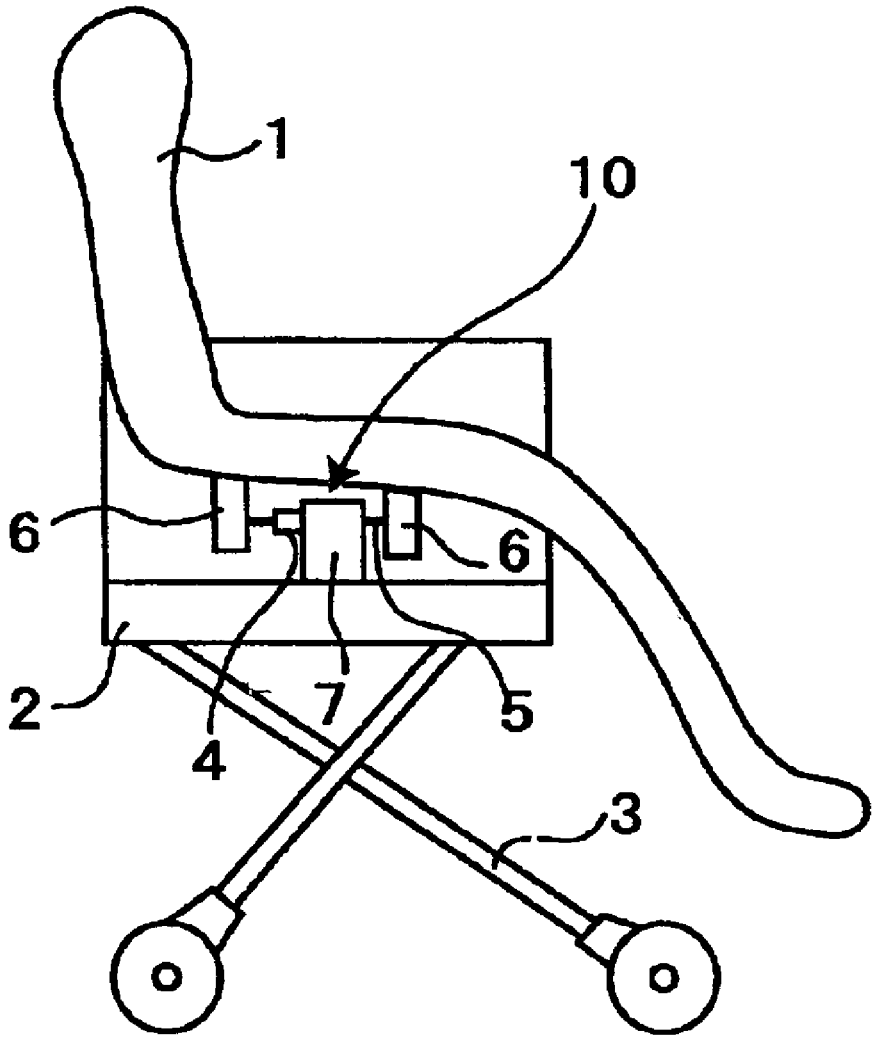
FIG. 2 is a side elevated view of the chair with a cross section taken along the line II—II in FIG. 1.
Figure 3:
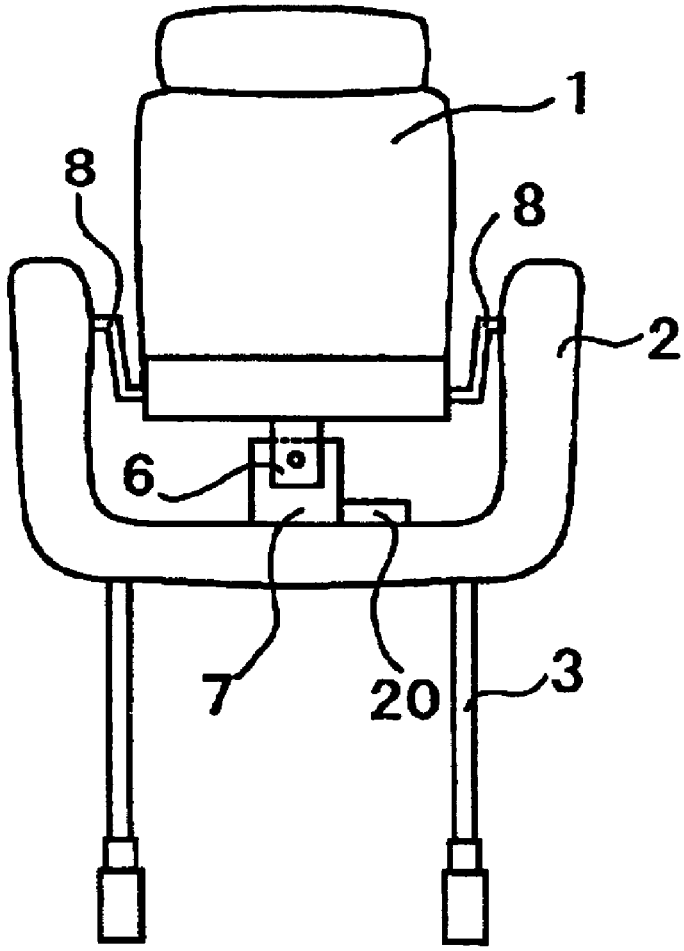
FIG. 3 is a front elevated view of the chair with a cross section taken along the line III—III in FIG. 1.

FIG. 1 is an overall perspective view illustrating an exemplary chair that incorporates a rocking seat control apparatus according to the present invention, the chair here being shown as an infant rocking chair. FIG. 1 is an overall perspective view of an infant rocking chair. FIG. 2 is a side elevated view of the chair with a cross section taken along the line II—II in FIG. 1, and FIG. 3 is a front elevated view of the chair with a cross section taken along the line III—III in FIG. 1.

The infant rocking chair shown includes a seat, a rack or a cradle (herein collectively referred to as "seat") 1, a fixed frame 2 provided with a pair of armrests for supporting the seat 1 in order that the seat 1 can be swayed or rocked, a rocking seat control apparatus 10 according to the present invention for controlling the rocking motion of the seat, and legs 3 attached to a fixed frame 2 so as to form an expandable and movable carriage of the chair.

Figure 4:
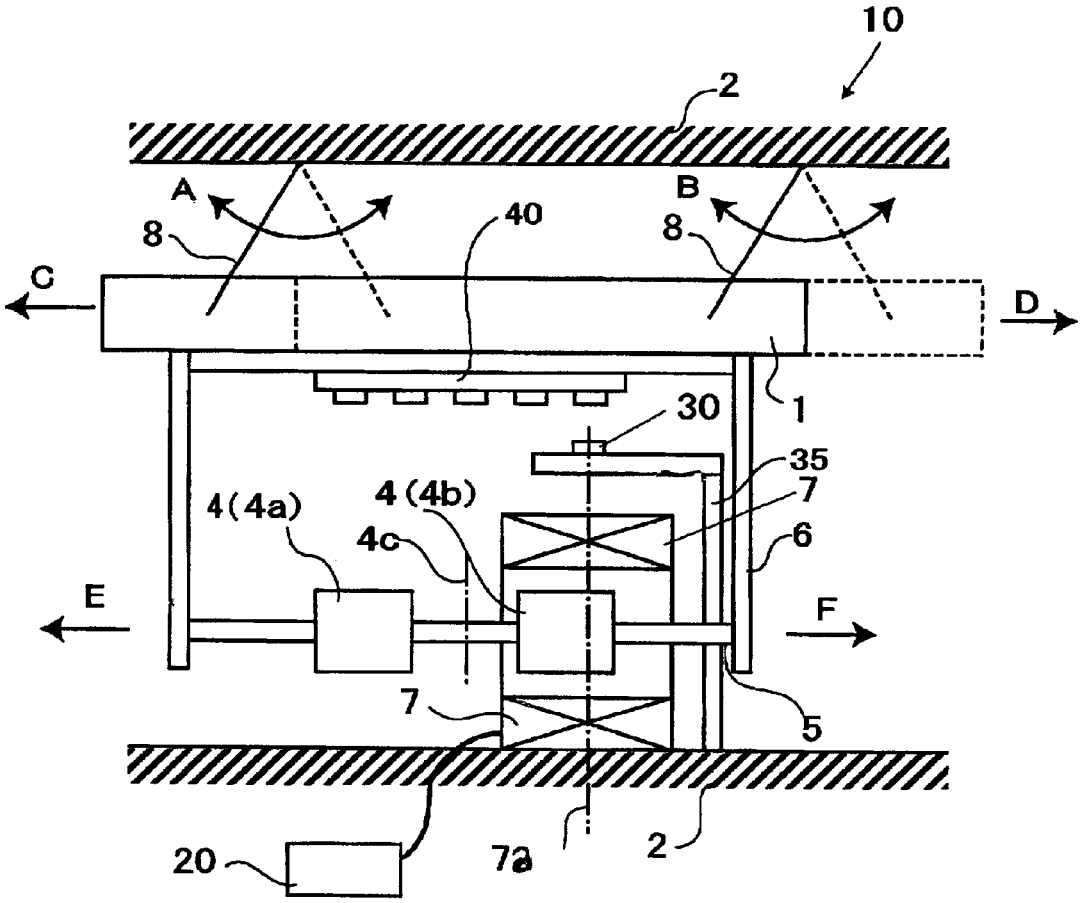
FIG. 4 is a diagrammatic view illustrating the makeup of a rocking seat control apparatus according to the present invention embodied in the first form of the embodiment thereof.

In FIG. 4, there is diagrammatically illustrated a certain form of embodiment of the rocking seat control apparatus 10 according to the present invention. In the rocking seat control apparatus 10 as shown in FIG. 4, the seat 1 is configured as supported from the fixed frame 2 via a pair of coupling rods 8 and 8 shown also in FIG. 3, so as to be capable of rocking or swaying. The seat 1 also has a rod 5 secured to its underside via a pair of attachment frames 6, and the rod 5 in turn has a magnetic member 4 (magnetic sub-members 4*a* and 4*b*) mounted thereon. Also included in the rocking seat control apparatus 10 are a solenoid 7 disposed on and attached to the fixed frame 2 so as to encircle the magnetic member 4 and a rocking seat control circuit 20 that energizes and drives the solenoid 7 in a controlled manner. In the form of the embodiment illustrated, it should be noted that the magnetic member 4 is subdivided in the direction of the seat rocking into two components 4*a* and 4*b*.

The seat 1 mentioned above may, for example, be of either a chair-like or a bed-like form, or of a tilt-back type that can easily be converted into both a chair or a bed. As illustrated, it is configured as supported at two points from the fixed frame 2 so as to be swayed relative thereto. The coupling rods 8 and 8 have their respective first ends coupled to the fixed frame 2 rotatably in the directions of the arrows A and B and their respective second ends rotatably coupled to the seat 1. The seat 1 is made movable in the directions of the arrows C and D. The seat 1 may otherwise be supported to be capable of undergoing a reciprocal movement in a horizontal plane.

The magnetic member 4 (magnetic sub-members 4*a* and 4*b*) mentioned above is made of a magnetic material such as, for example, iron, nickel or ferrite and, as illustrated, secured by means of the attachment frames 6 and the rod 5 to the seat 1 as a fixed part thereof.

The attachment frames 6 are those for attaching the rod 5 to the seat 1. The rod 5 extends parallel to the seat 1 and has a magnetic member 4 (magnetic sub-members 4*a* and 4*b*) mounted thereon. The rod 5 is made capable of rocking in the directions of arrows E and F. The magnetic member 4 is disposed so as to pass through a space that the solenoid 7 provides for.

The solenoid 7 mentioned above has its active space surrounding the magnetic member 4 (magnetic sub-members 4*a* and 4*b*) and is designed to attract the magnetic member 4 (magnetic sub-members 4*a* and 4*b*) when energized to magnetize. The solenoid 7 is energized for magnetization at a predetermined timing.

Figure 5:
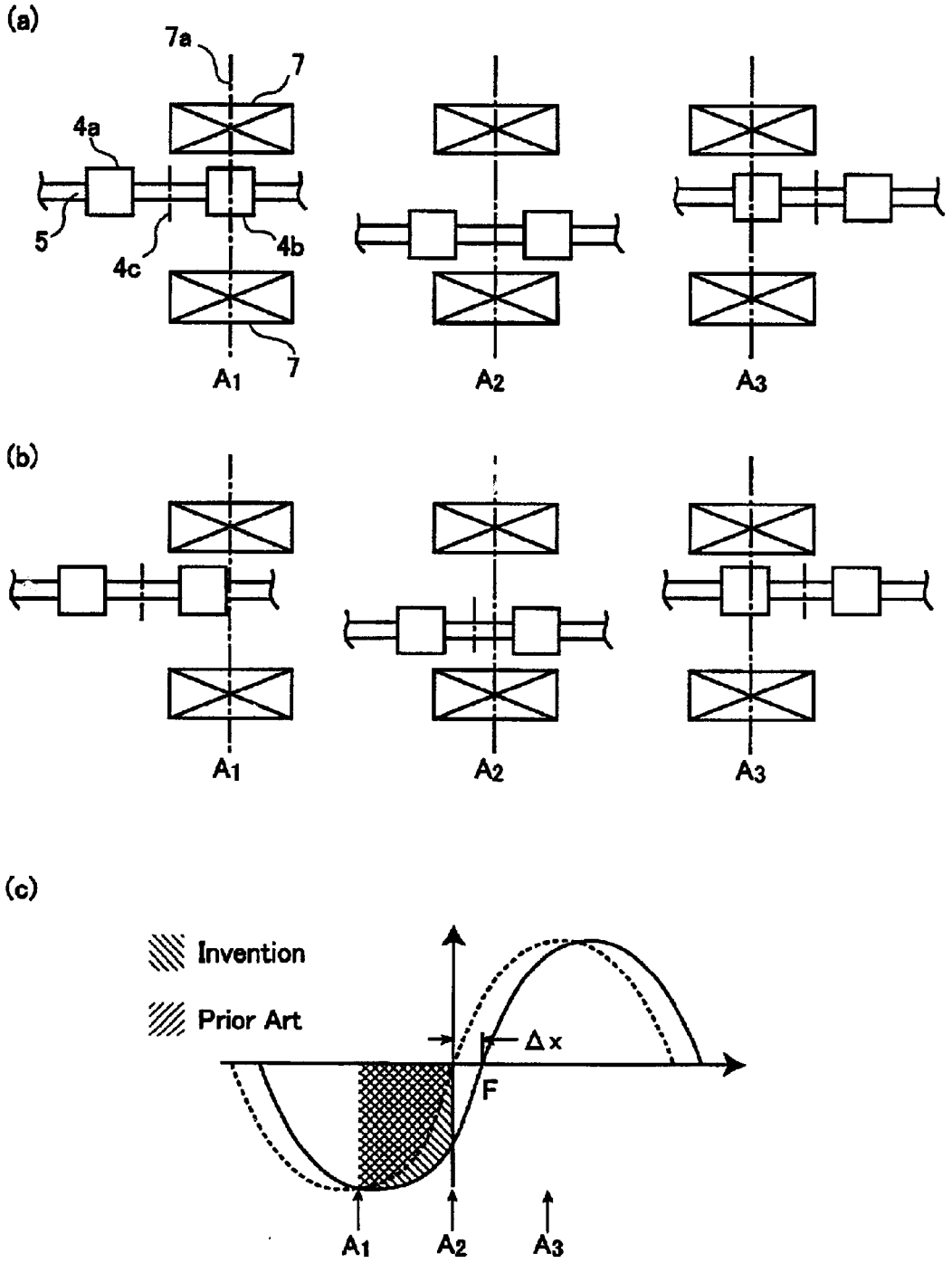
FIG. 5 shows the rocking principle of a seat rocking control apparatus according to the present invention.

The mid point 7*a* of the solenoid 7 is generally made coincident with the mid point 4*c* of the magnetic sub-members 4*a* and 4*b* so that in the state in which the seat 1 hangs down vertically by gravity, namely that it is at a standstill, the magnetic forces from the solenoid 7 on the magnetic members 4*a* and 4*b* are balanced oriented in mutually opposite directions. If the seat 1 is expected to carry a large load, it is advantageous to make an arrangement such that when the seat 1 is at a standstill the mid point 7*a* of the solenoid 7 lies displaced from the mid point c of the magnetic members 4*a* and 4*b* by a given certain distance Ax. FIG. 5 shows the rocking principle of a rocking seat control apparatus according to the present invention.

FIG. 5 illustratively compares the rocking principles in the rocking seat control apparatus according to the present invention shown in FIG. 5(*b*) with the rocking principle in the prior art shown in FIG. 5(*a*). Shown graphically in FIG. 5(*c*) is a difference in impulse between the prior art and the present invention. To illustrate the rocking seat control apparatus 10 of the present invention and the prior art counterpart, FIGS. 5A and 5B omit all components thereof other than the solenoid 7, the rod 5 and the magnetic member 4.

As shown, A1 represents the state of the seat 1 with its center lying to the left of the mid point 7*a* of the solenoid 7; A2 represents the state of the seat 1 with its center lying on the mid point 7*a* of the solenoid 7; and A3 represents the state of the seat 1 with its center lying to the right of the mid point 7*a* of the solenoid 7, respectively.

If the magnetic member 4 lies within the active space of the solenoid 7, the magnetic flux uniformly distributes passing through the solenoid 7 and a absence of force acts on the magnetic member 4.

On the other hand, if the magnetic member 4 lies protruding from the active space of the solenoid 7 or lies out of the active space of the solenoid 7, a magnetic force of attraction acts on the magnetic member 4, thereby attracting it towards the center of the solenoid 7.

In a rocking apparatus of the makeup mentioned above, it is typical to apply an electric current through the solenoid 7 when the center of the seat 1 is moving towards the center of the solenoid 7, thereby accelerating movement of the seat 1 with a resultant magnetic force of attraction. Also, to reduce the running cost of the apparatus, it is typical to make such acceleration during half of the rocking period, viz., where the center of the seat 1 lies on the left on right side from the mid point of the solenoid 7.

In the graph shown in FIG. 5C, the abscissa axis represents the position of the seat 1 expressed by the distance (x) of its effective center from the mid point 7*a* of the solenoid 7 taken as the origin. And, the ordinate axis represents a magnetic attraction force F(x) acting on the seat 1 at the magnetic member 4. Its positive region represents a magnetic force of attraction acting leftwards towards the mid point of the solenoid 7, and its negative region represents a magnetic force of attraction acting rightwards towards the mid point 7*a* of the solenoid 7.

In the case of the prior art as shown in FIG. 5(*a*) in which the mid point 4*c* of the magnetic sub-members 4*a* and 4*b* is made coincident with the mid point 7*a* of the solenoid 7 to cause the force acting on the magnetic member 4*a* and the force acting on the magnetic member 4*b* to be balanced when the seat 1 is at a standstill. As shown by the broken line curve in FIG. 5C, the magnetic force F(x) acting effectively on the seat 1 changes substantially sinusoidally with respect to the position of the seat 1 and becomes zero at the origin when the mid point 4*c* of the magnetic members 4*a* and 4*b* in the seat 1 becomes coincident with the mid point 7*a* of the solenoid 7. Considering a case that an acceleration of the seat 1 is effected in the left half of the period as shown, the work E ($=\int(x)dx$) done by the acceleration for the seat is found to be the area of the portion indicated by leftward down slanting lines in FIG. 5(*c*).

On the other hand, in the case of the present invention shown in FIG. 5(*b*) in which the midpoint 4*c* of the magnetic members 4*a* and 4*b* is arranged to lie displaced from the mid point 7*a* of the solenoid 7 by a given distance $\Delta x$, as shown by the solid line curve in FIG. 5(*c*), the magnetic force F(x) acting effectively on the seat 1 assumes a sinusoidal curve as mentioned above but parallel displaced rightwards. Considering a case that an acceleration of the seat 1 is effected in the left half of the period as shown, the work E ($=\int F(x)dx$) done by the acceleration for the seat 1 is found to be the area of the portion indicated by rightward down slanting lines in FIG. 5(*c*).

It is thus seen as shown in FIG. 5 that in accelerating the seat 1 the present invention gives rise to a greater work E than that is obtainable by the prior art, namely an enhanced impulse, which provides for the rocking seat 1 the capability of coping with greater loads acting thereon.

Referring back to FIG. 4, the seat 1 has on its bottom face a reflector 40 attached thereto. Also, the fixed frame 2 has a sensor mounting frame 35 standing therefrom, in which the upper arm has a sensor assembly 30 secured thereto and oriented so as to oppose to the reflector 40. The reflector 40 is provided to reflect a light from the sensor assembly 30, and the sensor assembly 30 is designed to emit light towards the reflector 40 and to accept light reflected from the reflector 40. Further, the sensor assembly 30 is located above the mid point 7*a* of the solenoid 7.

Figure 6:
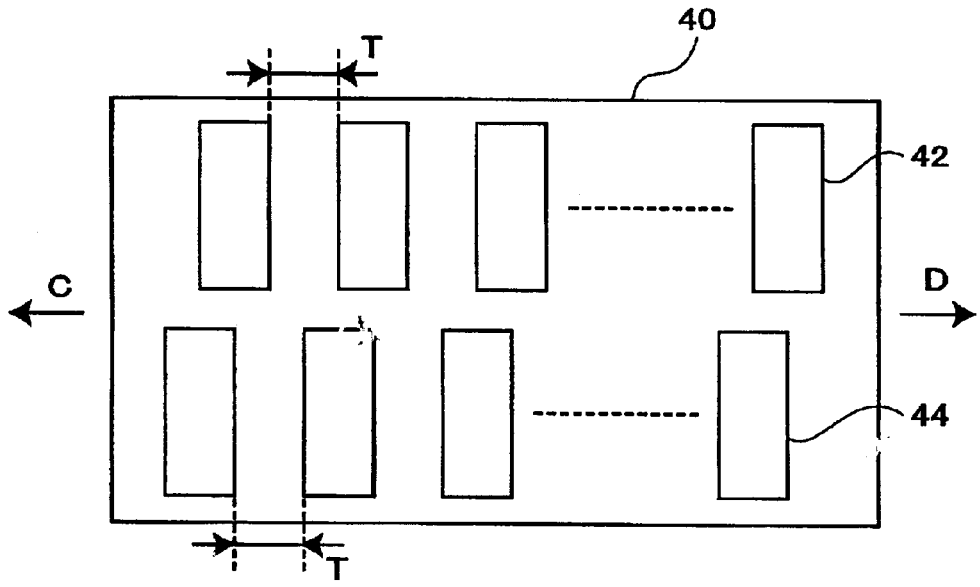
FIG. 6 is a top plan view of a reflector plate shown in FIG. 4, as viewed through the seat.
Figure 7:
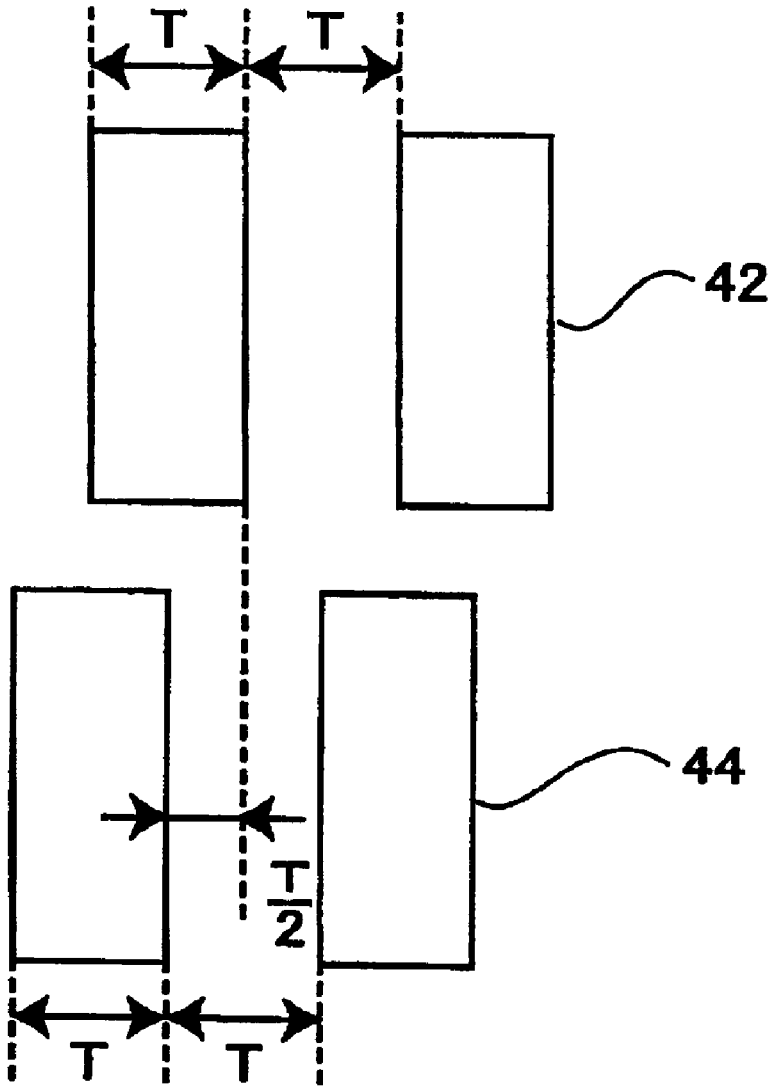
FIG. 7 is an enlarged view of a part of FIG. 6.

FIG. 6 is a top plan view of the reflector 40 as seen from the top through the seat 1. As shown in FIG. 6, the reflector 40 is provided with a group or row of reflector plates 42 and a second group or row of reflector plates 44 which are the same in number and both of which are designed to reflect a light emitted from the sensor assembly 30. The regions of the reflector other than those reflector plates 42 and 44 are made incapable of reflecting light. The reflector plates of the first group 42 and the reflector plates of the second group 44, as shown enlarged in FIG. 7, have each a predetermined width T in the seat 1 rocking directions C and D, and are set in a pair of rows in the seat 1 rocking directions C and D with the reflector plates in each of the first and second rows 42 and 44 being spaced apart from each other by a predetermined spacing T in the seat 1 rocking directions C and D that is equal to the width T of each of the reflector plates 42 and 44. The reflector plates of the first row 42 are displaced in position in the seat 1 rocking directions C and D by a distance of T/2 from the corresponding reflector plates of the second row 44.

Figure 8:
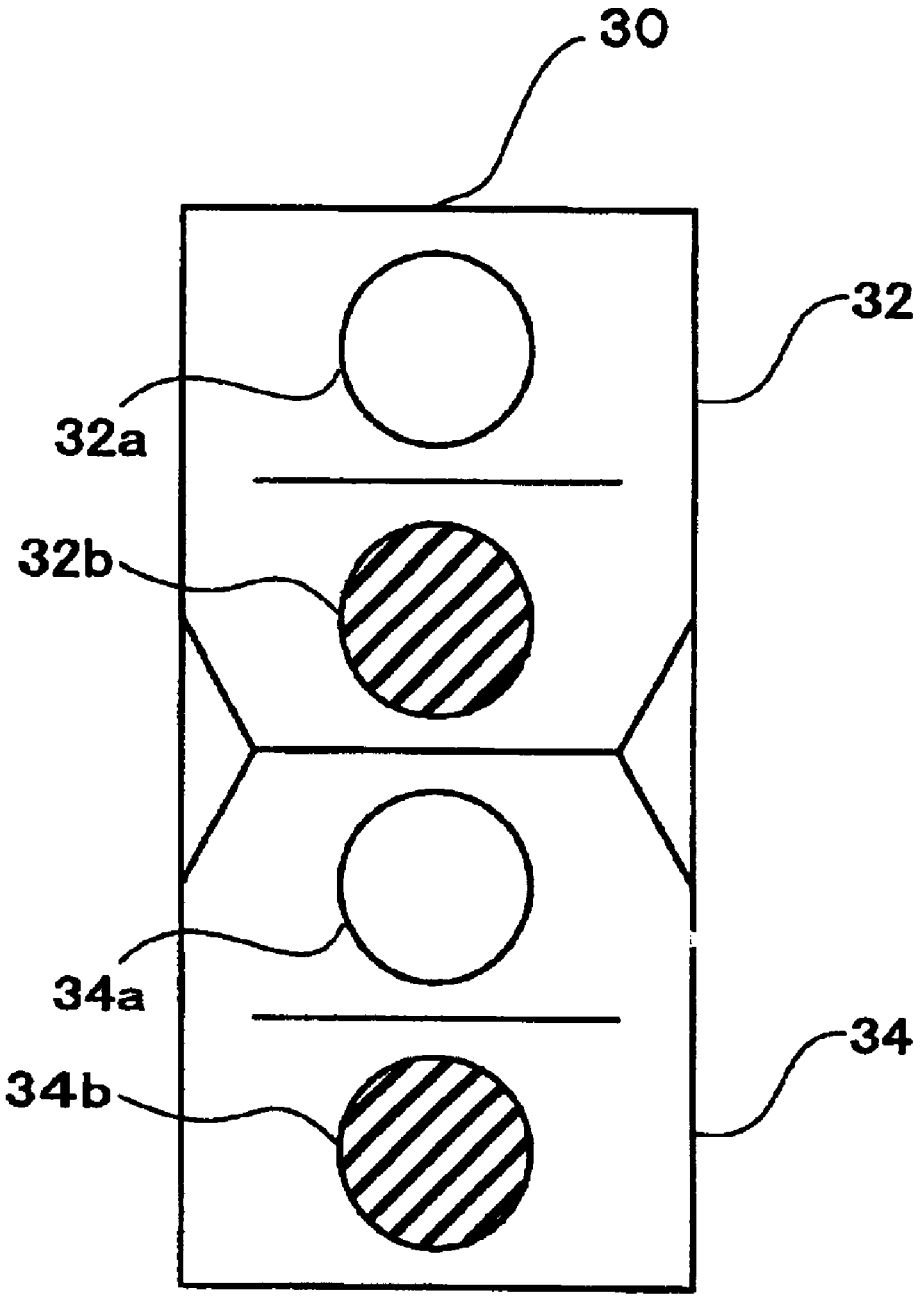
FIG. 8 is a top plan view illustrating a sensor assembly shown in FIG. 4.

FIG. 8 shows the sensor assembly 30 in a top plan view. As shown, the sensor assembly 30 comprises a first and a second sensor 32 and 34, which are united with each other, corresponding to the first group of reflector plates 42 and the second group of reflector plates 44, respectively. The first sensor 32 includes a first light emitter 32*a* and a first light receiver 32*b*. The first light emitter 32*a* emits light towards the reflector plates in the first row 42. The first light receiver 32*b* receives light reflected from the reflector plates in the first row 42 and in response thereto produce a signal. The first light emitter 32*a* and the first light receiver 32*b* can be implemented, for example, by a photocoupler. The second sensor 34 includes a second light emitter 34*a* and a second light receiver 34*b*. The second light emitter 34*a* emits light towards the reflector plates in the second row 44. The second light receiver 34*b* receives light reflected from the reflector plates in the second row 44 and in response thereto produce a signal. The second light emitter 34*a* and the second light receiver 34*b* can be implemented, for example, by a photocoupler.

Figure 9:
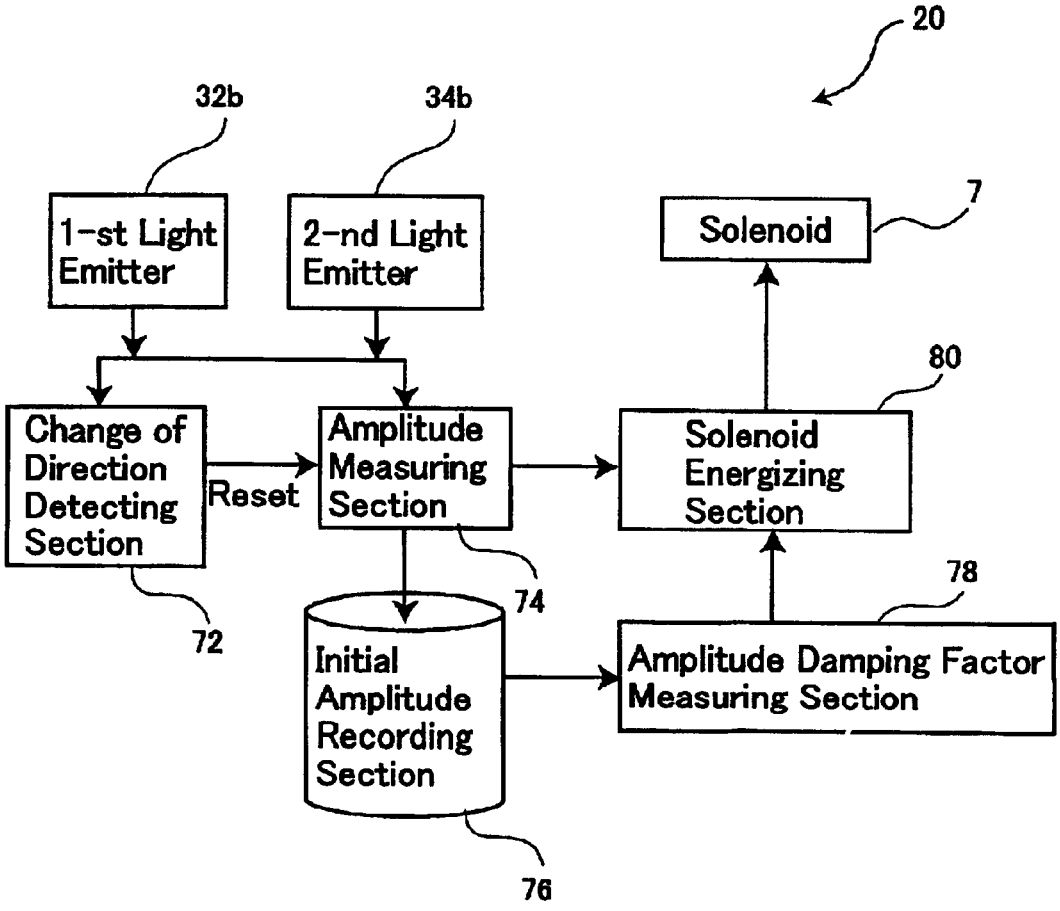
FIG. 9 is a block diagram illustrating a rocking seat control circuit according to the said first form of the embodiment of the present invention.

FIG. 9 shows a block diagram of a rocking seat control circuit 20 that represents a first form of the embodiment of the present invention. The rocking seat control circuit 20 includes the solenoid 7, the first right receiver 32*b*, the second light receiver 34*b*, a change of direction detecting section 72, an amplitude measuring section 74, an initial amplitude recording section 76, an amplitude damping factor measuring section 78 and a solenoid magnetizing (energizing) section 80.

The solenoid 7, the first light receiver 32*a* and the second light receiver 34*b* may be those described so far, and a repeated description thereof is omitted. The change of direction detecting section 72 is provided to detect a change in the rocking direction of the seat 1 (from the arrow C to the arrow D or from the arrow D to the arrow C) in accordance with a pattern of signals produced by the first and second light receivers 32*a* and 34*b*. The amplitude measuring section 74 is to measure the rocking amplitude of the seat 1 in response to the number of signals produced by the first and second light receivers 32*b* and 34*b*. The initial amplitude recording section 76 is to record the initial seat 1 rocking amplitudes in the positive (D) and negative (C) directions for deriving the amplitude damping factor associated with the rocking of the seat 1. The amplitude damping factor measuring section 78 is used to derive the amplitude damping factor associated with the rocking motion of the seat 1 from the data recorded in the initial amplitude recording section 76. The solenoid magnetizing (energizing) section 80 is designed to derive the applied distance (i.e. the distance by which the seat 1 advances while the solenoid 7 is being energized) by the rocking amplitude of the seat 1 obtained from its measuring section 74 and the amplitude damping factor given from its measuring section 78 and to energize the solenoid 7 with a drive current while the seat 1 advances from a given position by the applied distance.

Figure 10:
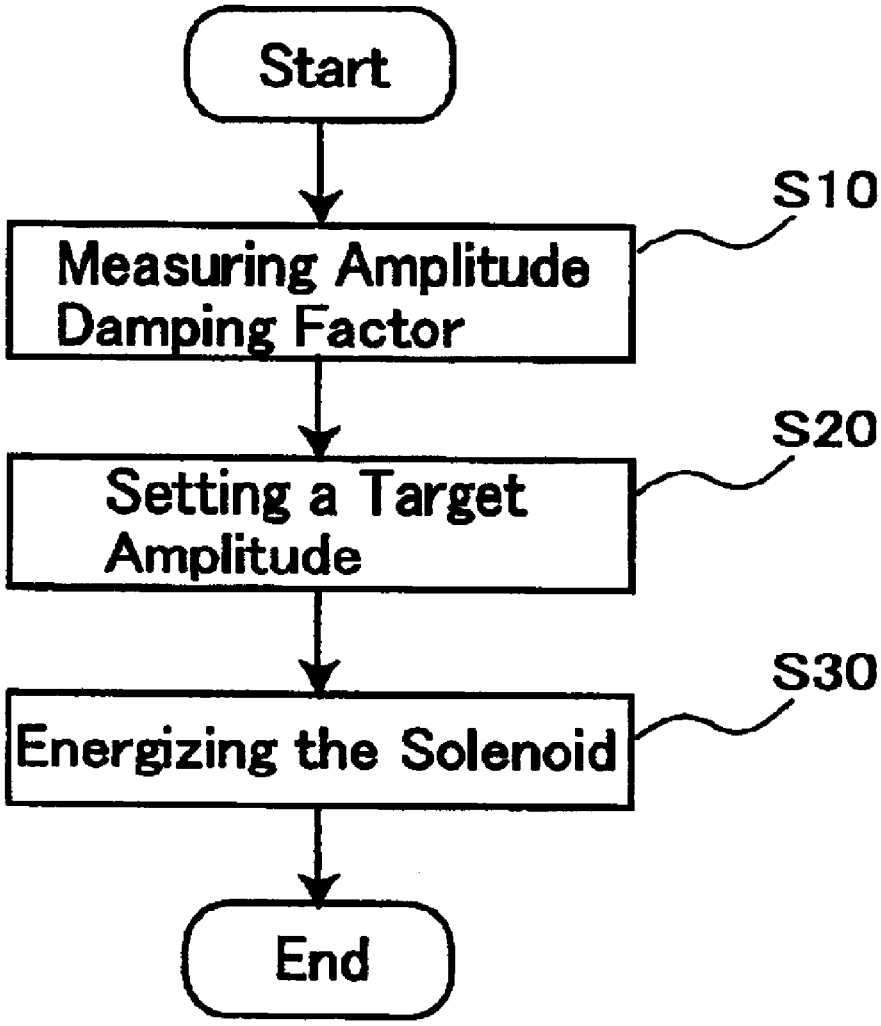
FIG. 10 is a flow chart illustrating an operation of the rocking seat control circuit according to the said first form of the embodiment of the present invention.

A mention is next made of an operation of the first form of an embodiment of the present invention. FIG. 10 illustrates in a flow chart of an operation of the first form of the embodiment of the present invention in which the rocking amplitude of the seat is maintained constant. In the operation, a factor indicating the rocking amplitude damping factor while the seat 1 is being swayed is first derived in step S10. Then, a user's target amplitude for the seat 1 rocking is set in step S20. Thereafter, the solenoid 7 is energized to give a desired impulse to the seat 1 in step S30. This allows the seat 1 to continue to sway and rock accordingly.

Figure 11:
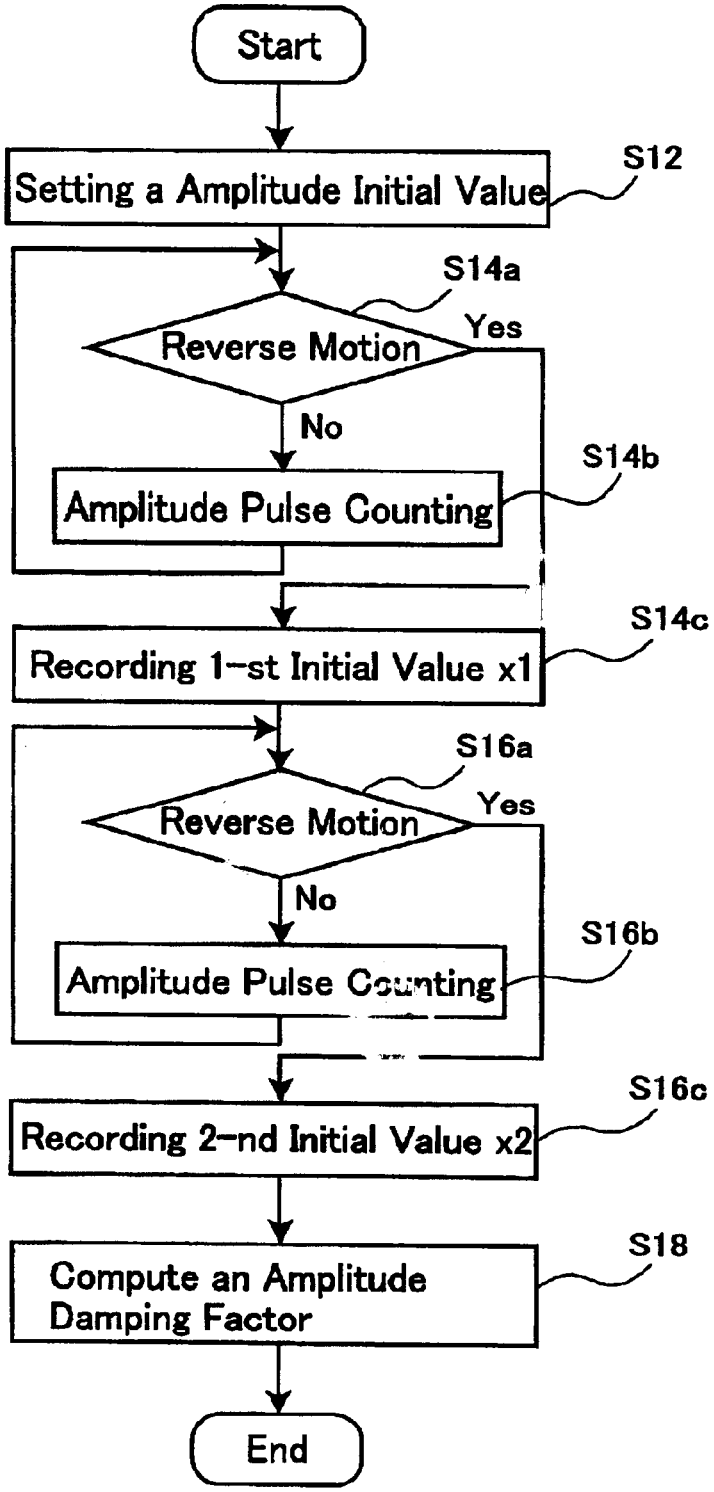
FIG. 11 is a flow chart illustrating in detail a process of amplitude damping factor measurement in the said first form of the embodiment of the present invention.

FIG. 11 illustrates a detailed flow chart in the process step (S10) of the measurement of the amplitude damping factor.

Figure 12:
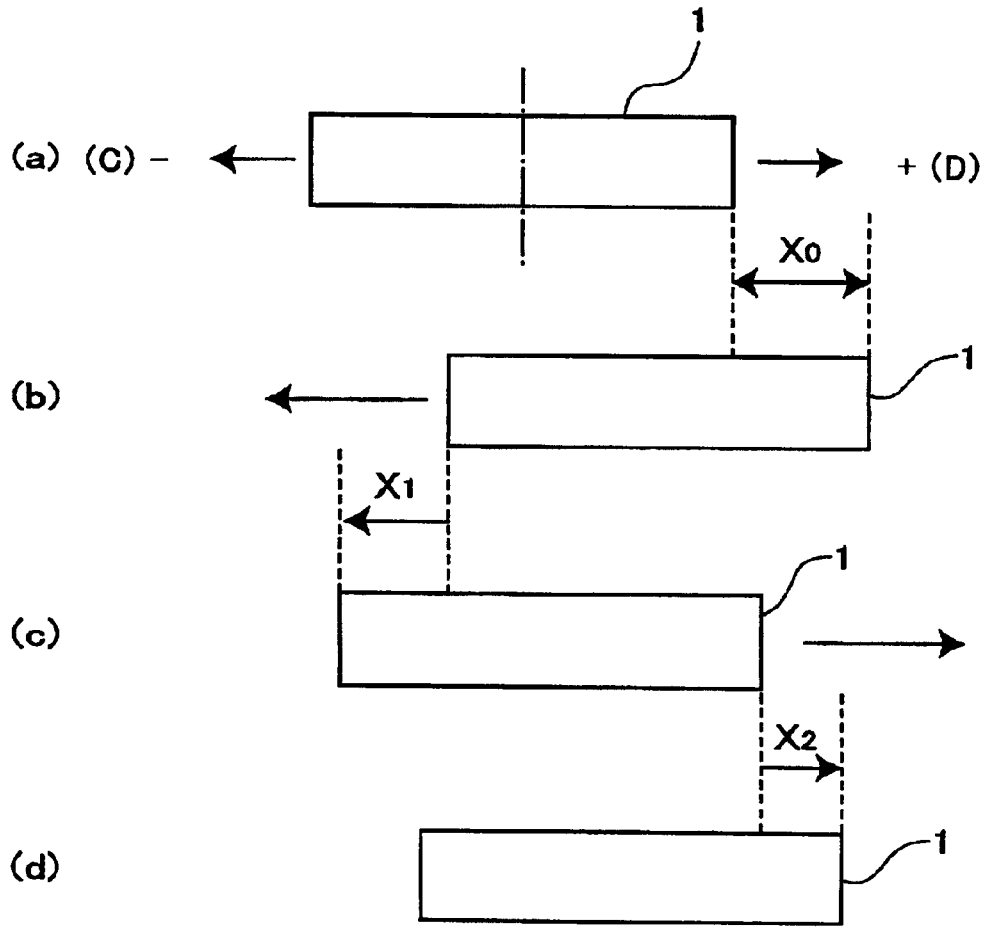
FIG. 12 is a diagrammatic view illustrating changes in position of the seat in the said first form of embodiment of the present invention in which (a), (b), (c) and (d) represent a balanced position, an initial position, a position with the first initial amplitude X1 taken, and a position with the second initial amplitude X2 taken, respectively.

Here, the solenoid 7 is left unenergized, however. First, the seat 1 is displaced by an arbitrary distance X0 in the positive (D) direction in step S12. Thus, the seat 1 is displaced from its initial position shown in FIG. 12 at (a) to an arbitrary position shown in FIG. 12 at (b). This will cause the seat 1 to move and rock in the negative (C) direction. Then, referring back to FIG. 11, as long as the change of direction detecting section 72 does not detect a change in direction of the movement of the seat 1 (see S14*a*, No), the amplitude measuring section 74 continues to measure the amplitude in step S14*b*. If the change of direction detecting section 72 detects the change of direction to the positive (D) direction (step S14*a*, Yes), it records in the initial amplitude recording section 76 a first initial amplitude X1, indicated in FIG. 12 at (c), as the amplitude towards the negative (C) direction in step S14*c*.

Figure 13:
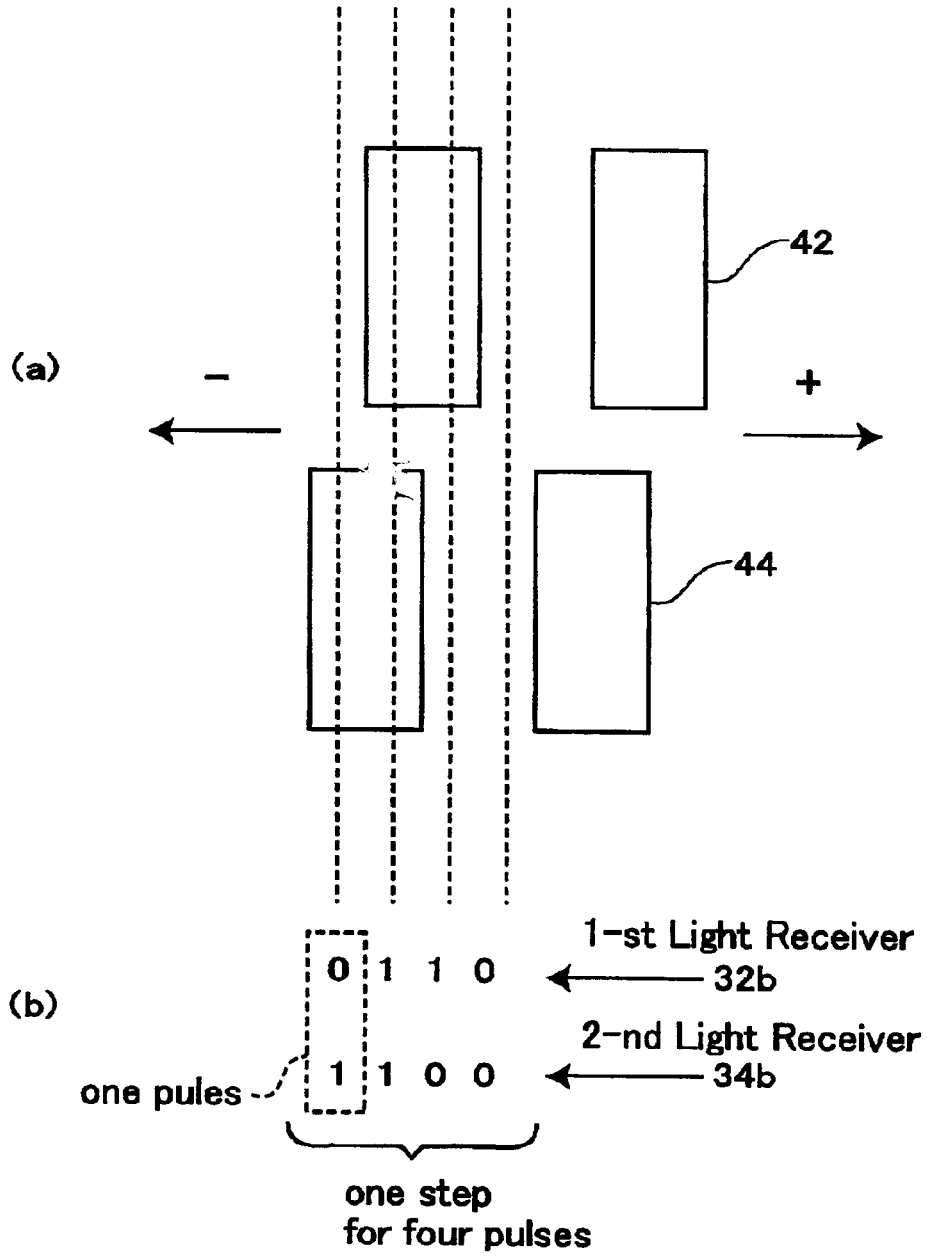
FIG. 13 is a diagrammatic view illustrating the principles in the said first form of the embodiment of the present invention under which the detection of a reverse motion of the seat by the change of direction detecting section and the measurement of an amplitude by an amplitude measuring section are effected.

Here, with reference to FIG. 13, the mention is made of how a change of direction or reverse motion of the moving seat 1 is detected by the change of direction detecting section 72 and how a rocking amplitude of the seat 1 is measured by the amplitude measuring section 74. Since the reflector plates of the first row 42 and the reflector plates of the second row 44 as shown in FIG. 13 at (a) are deviated in position in the directions in which the seat 1 is driven to move, the first and second light receiver 32*b* and 34*b* gas they move in the positive direction with the light emitters 32*a* and 34*a* relative to the reflector plates of first and second rows 42 and 44 (moving with the seat 1 in the negative direction) will have a pattern of their output signals varying as follows: (0,1), (1,1), (1,0), (0,0), . . . as shown in FIG. 13(*b*). Likewise, the first and second light receivers 32*b* and 34*b* as they move in the negative direction with the light emitters 32*a* and 34*a* relative to the reflector plates of first and second rows 42 and 44 (moving with the seat 1 in the positive direction) will have a pattern of their output signals varying as follows: (0,0), (1,0), (1,1), (0,1), . . . .

Thus, determining particular directions in which the first and second light emitters 32*a* and 34*a* move relative to the reflector plates of first and second rows 42 and 44 moving with the seat 1 in terms of particular patterns of change of the output signals of the light receivers 32*b* and 34*b* permits the change of direction detecting section 72 to detect a reverse motion of the seat 1 from the output signals of the first and second light receivers 32*b* and 34*b*.

Also, to measure the amplitude of the rocking motion of the sea 1, the amplitude measuring section 74 may count one (1) pulse each time each of the first and second light receivers 32*b* and 34*b* has its output signal varied either from 0 to 1 or from 1 to 0, and may then count one step for four (4) pulses in as much as each of the first and second light receivers 32*b* and 34*b* has an original output signal for every four (4) pulses. Then, one (1) pulse will correspond to a distance of 0.5 T and one (1) step will correspond to a distance of 2T, thus permitting the amplitude of the rocking motion of the seat 1 to be measured from the number of pulses and the number of steps counted.

Now referring back to FIG. 11, as long as the change of direction detecting section 72 has not detected a reverse motion of the seat 1 (the output No of step S16*a*), the amplitude measuring section 74 will continue to measure the amplitude (step S16*b*). Then, when the change of direction detecting section 72 detects a reverse motion of the seat 1 to the positive (D) direction, the step issue the output Yes that permits a second initial amplitude X2 (see FIG. 11(*d*)) to be recorded as the amplitude in the positive direction in the initial amplitude recording section 76 in step S16*c*. Finally, in step S18 the amplitude damping factor measuring section 78 calculates a damping factor (X1−X2)/X1.

Figure 14:
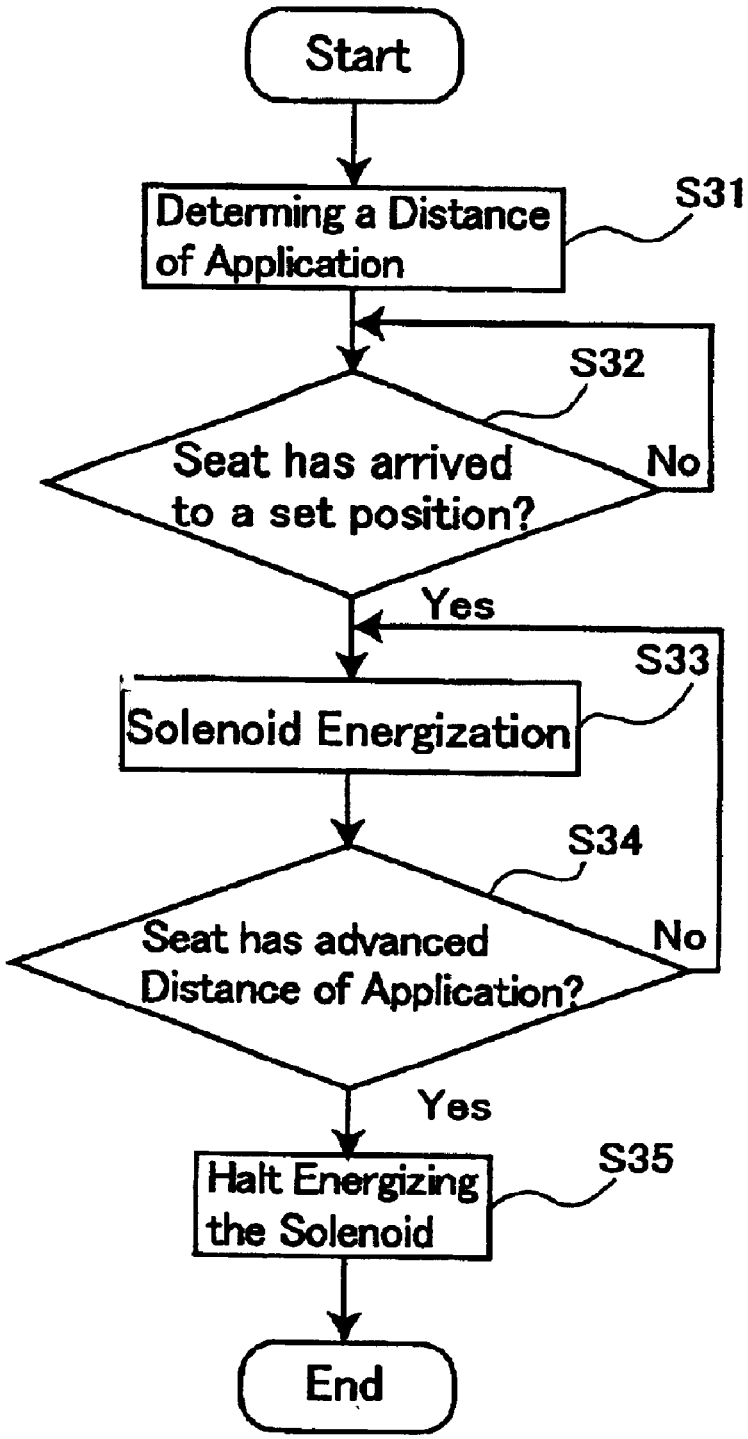
FIG. 14 is a flow chart illustrating in detail a process of energizing to magnetize the solenoid in the first form of the embodiment of the present invention.

FIG. 14 shows a flow chart of a detailed process of energizing to magnetize the solenoid 7 shown by S30 in FIG. 10. First, in step S31 the solenoid energizing section 80 determines a distance of the application, which is derived by multiplying the rocking motion (the distance traveled by the seat 1 from one reverse motion to the next turnabout) measured by the amplitude measuring section 74 by the damping factor measured by the amplitude damping measuring section 78 (step S31).

Then, in step S32 the solenoid energizing section 80 monitors to determine from measurement results of the amplitude measuring section 74, whether or not the seat 1 has arrived at a predetermined position. If it has not arrived (S32, No), the section 80 will continue to so monitor. If it has arrived (S32, Yes), the section 80 will commence energizing the solenoid 7 in step S33. Then, the solenoid energizing section 80 monitors in step S34 to determine from the measurement results of the amplitude measuring section 74, whether or not the seat 1 has advanced from the predetermined position to the distance of application. If it has not (S34, No), the section 80 will continue to so monitor. If it has (S34, Yes), the solenoid energizing section 80 will stop energizing the solenoid 7 in step S35.

In accordance with the first form of embodiment of the present invention mentioned above, it will be seen that displacing each successive pair of reflector plates of the first and second rows 42 and 44 from each other by a distance of half the width T of each reflector plate of the first row 42 allows the amplitude of the rocking motion of the seat 1 to be measured in units each of which is half the width of each reflector plate of the first row 42. Moreover, a change made in the light receiving pattern of the first and second light receivers 32*b* and 34*b* according to the directions in which the seat 1 is moved in its rocking motion permits a reverse motion of the seat 1 in its rocking to be detected from a particular light receiving pattern of the first and second light receivers 32*b* and 34*b*.

Permitting a reverse motion and an amplitude of a rocking motion of the seat 1 to be detected in this manner further allows respective displacements X1 and X2 of the seat 1 in the positive and negative directions to be determined. This also permits an amplitude damping factor of the seat 1 during its rocking motion to be determined as well by the amplitude damping factor measuring section 78. Moreover, permitting the amplitude of rocking motion of the seat 1 to be measured by the amplitude measuring section 74 enables a distance of application to be calculated from the rocking motion and amplitude damping factor. Furthermore, the solenoid energizing section 80 determines a duration in which the solenoid 7 is energized from the determined distance of application. This permits a desired impulse to be imparted to the seat 1. It follows, therefore, that imparting an impulse that compensates in magnitude for an attenuation of the amplitude caused during rocking cycles of the seat 1 from the solenoid energizing section 80 to the seat 1 allows the seat 1 to be held swayed with a preselected constant rocking amplitude.

An explanation is next given in respect of a rocking seat control apparatus that represents a second form of the embodiment of the present invention. It should be noted here that the apparatus may have the same mechanical structure as shown and described in connection with FIG. 1 with respect to the first form of the embodiment.

Figure 15:
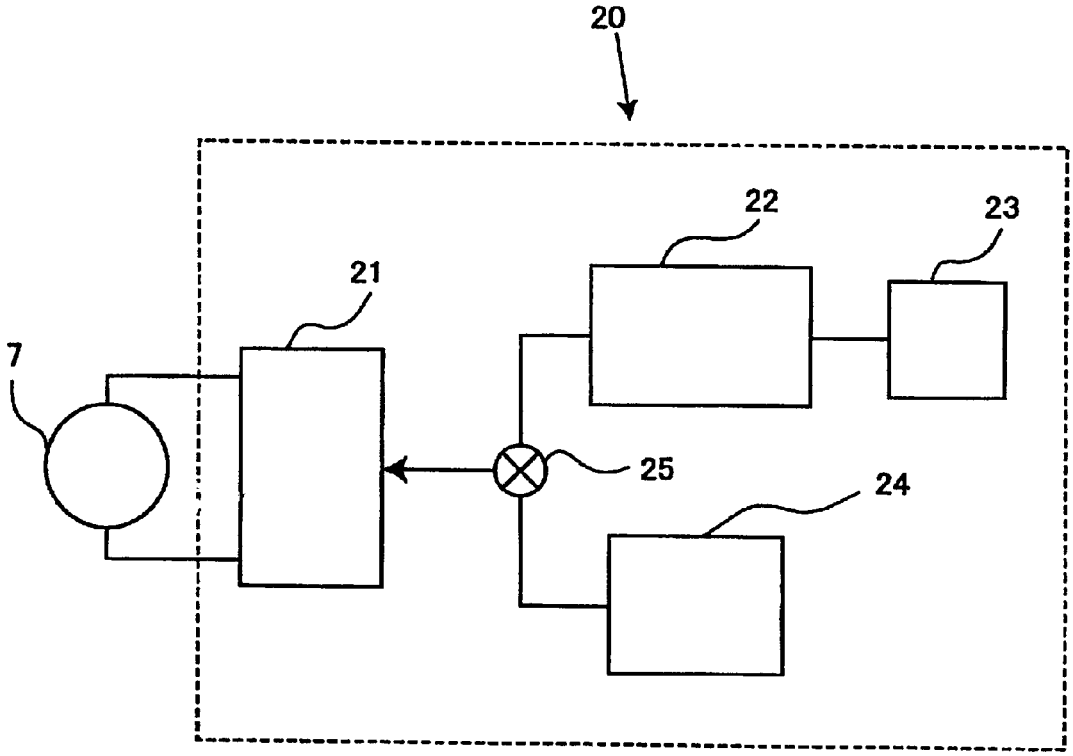
FIG. 15 is a block diagram illustrating a rocking control circuit as the second form of embodiment in a rocking seat control apparatus according to the present invention.

FIG. 15 shows a block diagram of a rocking seat control circuit 20 according to the second form of the embodiment of the present invention. The rocking seat control circuit 20 includes a solenoid drive circuit 21 for driving the solenoid 7 in a controlled manner, a 1/f-type spectrum fluctuation computing circuit 22, an initial value input section 23, a target rocking motion input section 24 and a switching circuit 25.

The solenoid drive circuit 21 here is furnished with output signals of the amplitude measuring section 74 and the amplitude damping factor measuring section 78, as shown in FIG. 9 and as described in connection with the first form of the embodiment, to energize the solenoid 7 for a duration determined by the change of direction detecting, the amplitude measuring and amplitude damping factor such that the seat 1 may have a target rocking motion input into the solenoid drive circuit 21.

The 1/f-type spectrum fluctuation is a fluctuation in which the power of a sine wave (the square of its amplitude) with which the waveform of a fluctuation is expanded by the sine wave series has a spectrum that is inversely proportional to the frequency f of the sine wave. Nature fresh are or pleasant, relaxing music in many instances have a 1/f-type spectrum fluctuation.

Figure 16:
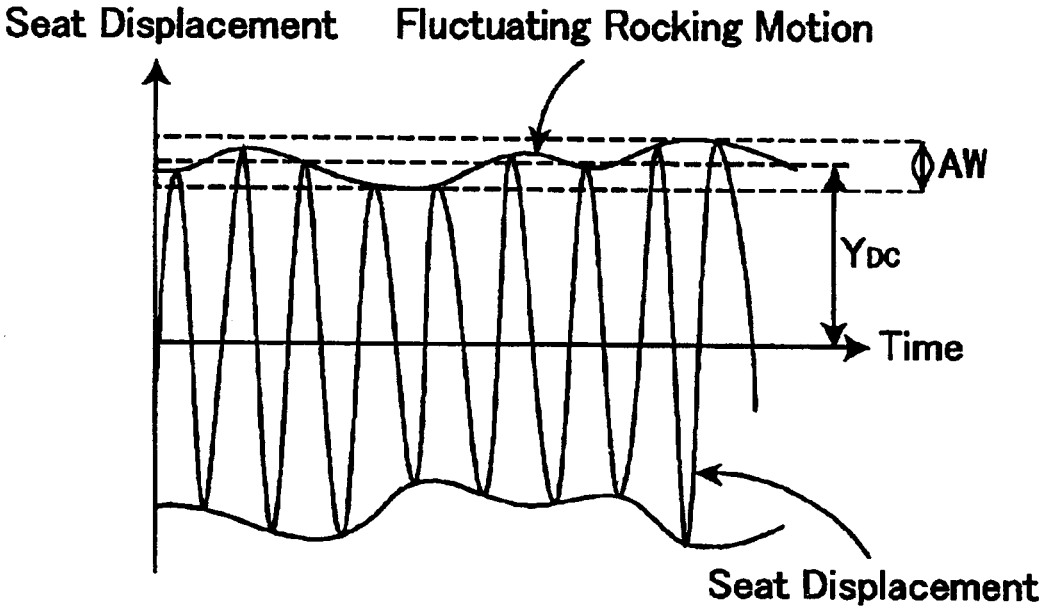
FIG. 16 is a graph illustrating a typical fluctuating waveform computed by a 1/f-type spectrum fluctuation computing circuit in the rocking control circuit in the second form of embodiment of the present invention.

The 1/f-type spectrum fluctuation computing circuit 22 mentioned above is designed to respond to an initial value of the 1/f-type spectrum entered by the initial value input section 23 and to derive on computation therefrom a waveform of rocking motion that fluctuates with time as shown in FIG. 16, namely to compute a fluctuating waveform of rocking motion.

Figure 17:
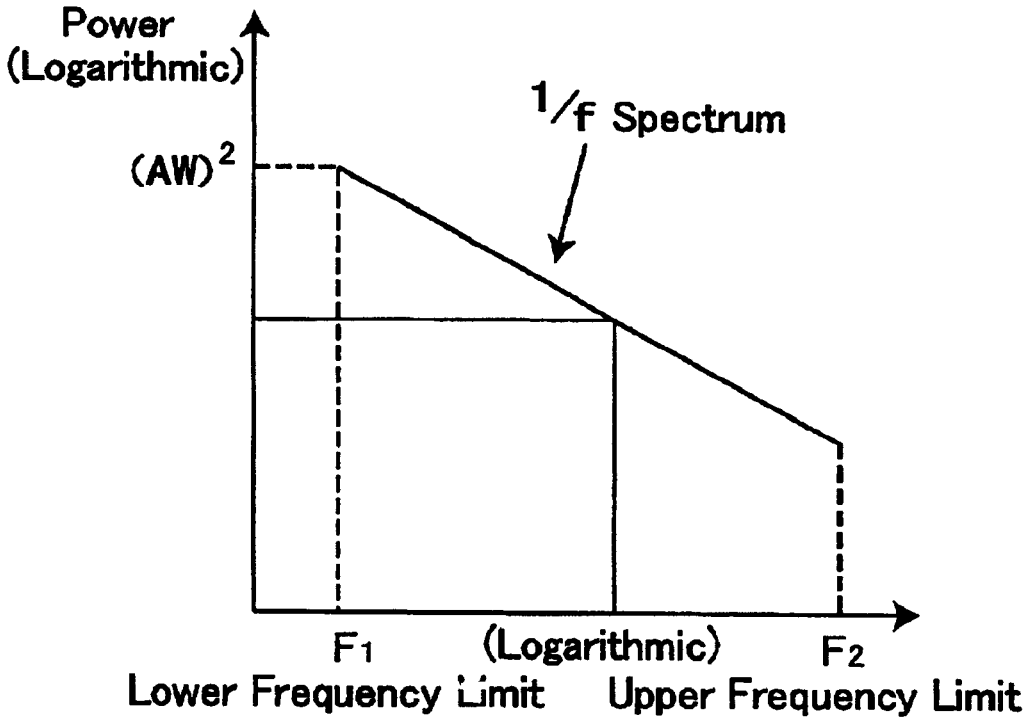
FIG. 17 is a logarithmic graph illustrating a 1/f-type spectrum used in the 1/f-type spectrum fluctuation computing circuit in the rocking control circuit in the second form of embodiment of the present invention.

A fluctuating waveform of rocking motion as mentioned above is computed as stated below with reference to FIG. 17, according to the relationship that the power of a sine wave (the square of its amplitude) is inversely proportional to the frequency of the sine wave, namely on the basis of its 1/f spectrum.

Here, the initial values of a 1/f-type spectrum are for the lower and upper frequency limits F1 and F2 of the 1/f spectrum, the amplitude AW of the sine wave of the frequency F1 and the DC component of the fluctuation $Y_{DC}$, which are entered at the initial value input section 23.

Then, on the basis of these initial values of the 1/f-type spectrum the 1/f-type spectrum fluctuation computing circuit 22 divides the difference between frequency F2 and frequency F1 into n equal parts to derive a frequency width ΔF:

$$\Delta F=(F2-F1)/n$$

and computes the amplitude Ai of a sine wave ψi for each of frequencies fi:

$$fi=F1+\Delta fxi$$

where I=0, 1, 2, . . . , n. The amplitude Ai of each sine wave ψi is then derived from the relationship, as shown in FIG. 17, that for the 1/f-type spectrum the square of an amplitude is inversely proportional to a frequency, namely, $$Ai=\left((AW)^2\times\frac{F1}{fi}\right)^{\frac{1}{2}}$$

with initial values entered for AW and F1.

The 1/f spectrum fluctuation computing circuit 22 further sets a phase φi of each sine wave ψi through random number generation to establish the sine wave ψi and then on synthesizing these sine waves ψi derives a fluctuating waveform as sought. To do this, the 1/f spectrum fluctuation computing circuit 22 assuming that the angular velocity of each sine wave ψi is ωi and the time interval of computation is Δt computes the phase angle at time $t_j$:

$$\omega_i\times t_j=2\pi f_1\times\Delta t\times j$$

where i=1, 2, . . . , n and j=1, 2, . . . , n to derive a fluctuating rocking motion $Y_j$ at each moment of time $t_j$:

$$Y_j=Y_{DC}+\sum_{i=0}^{n}Ai\sin(\omega_1 t_j+\phi_i),\quad j=0.$$

The 1/f spectrum fluctuation computing circuit 22 calculates a target value thereof that gives a target rocking motion of the seat 1 to furnish the drive circuit 21 therewith from the derived fluctuating rocking motion $Y_j$.

In this manner, the 1/f spectrum fluctuation computing circuit 22 computes a fluctuating rocking motion $Y_j$ at each point of time $t_j$ on the basis of initial values of the 1/f spectrum entered at the initial value input section 23, and further computes a target value having a fluctuation imparted thereto for output.

Opposed to the 1/f spectrum fluctuation computing circuit 22 mentioned above, however, the target rocking motion input section 24 is designed to preset a constant target value without any fluctuation.

The switching circuit 25 comprised of, for example, a switch, is designed to enter a target value from the 1/f spectrum fluctuation computing circuit 22 and a target value from the target rocking motion input section 21 selectively into the drive circuit 21. This gives the apparatus the ability to switch rocking modes for the seat 1, i.e., between a fluctuating rocking mode by a target value with a fluctuation from the 1/f spectrum fluctuation computing circuit 22 and a constant rocking mode by a constant target value from the target rocking motion input section 24.

The rocking seat control apparatus 10 as the second form of the embodiment of the present invention constructed mentioned above operates as stated below. A mention is first made of an operation of the rocking seat control apparatus 10 in a fluctuating rocking mode where the switching circuit 25 of the rocking seat control circuit 20 connects the 1/f spectrum fluctuation computing circuit 22 to the drive circuit 21.

Figure 18:
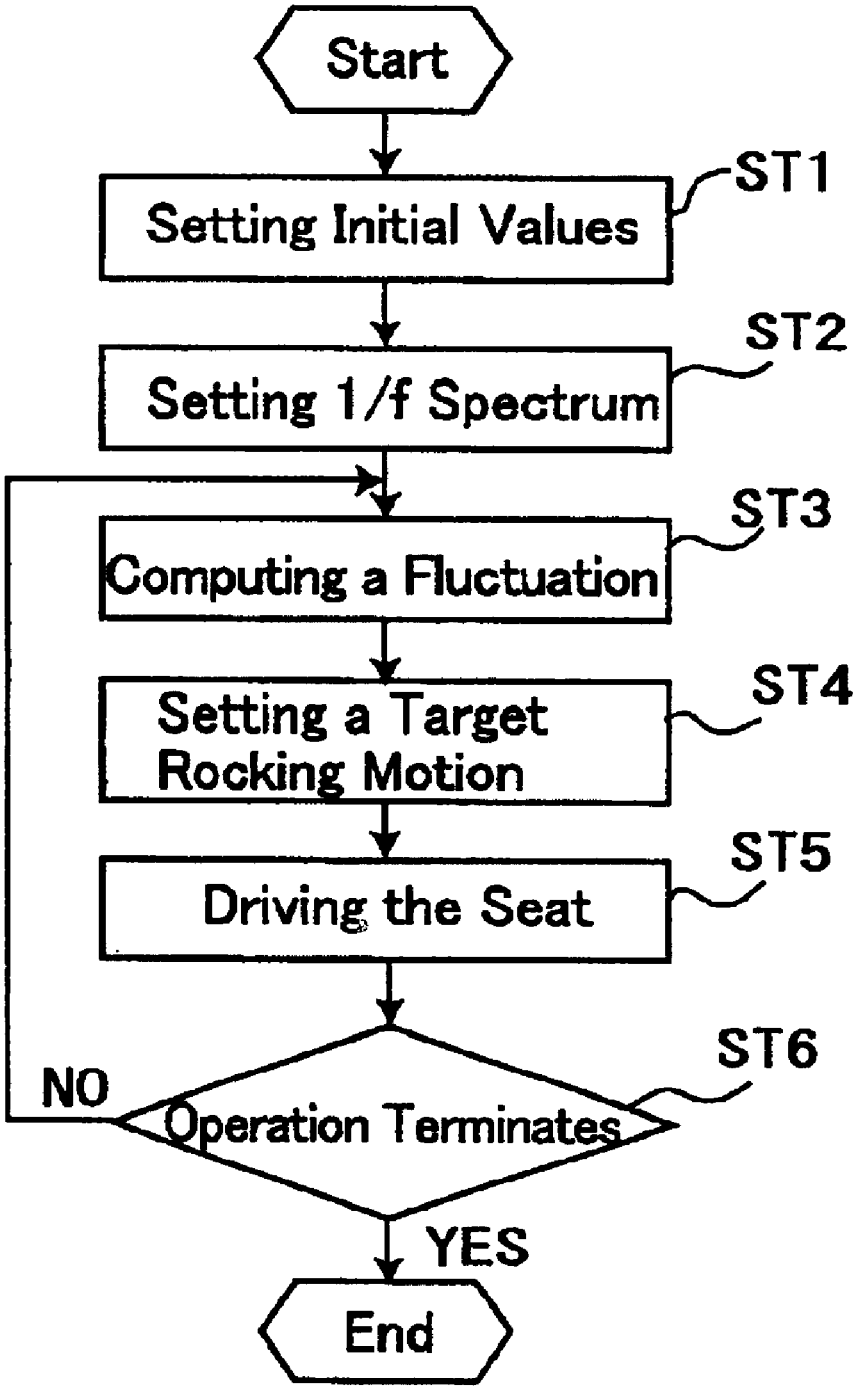
FIG. 18 is a flow chart illustrating an operation of the rocking seat control apparatus in a fluctuating rocking mode according to the second form of embodiment of the present invention.

The rocking seat control apparatus 10 of the fluctuating rocking mode operates as illustrated in FIG. 18.

Referring to FIG. 18, initial values are entered in step ST1 at the initial value input section 23 for the lower and upper frequency limits F1 and F2, the amplitude AW of a sine wave of the frequency F1, and the DC component of a fluctuation $Y_{DC}$.

Then, in step ST2, the 1/f spectrum fluctuation computing circuit 22 computes the frequencies fi and the amplitude Ai of sine waves ψi on the basis of the 1/f spectrum and the initial values mentioned above.

Next, in step ST3, the 1/f spectrum fluctuation computing circuit 22 sets up a phase φi of each sine wave ψi through random number generation and then computes a fluctuating rocking motion Yj upon synthesizing all the sine waves.

Thereafter, in step ST4, the 1/f spectrum fluctuation computing circuit 22 converts the fluctuating rocking motion Yj into a target value. Namely, the 1/f spectrum fluctuation computing circuit 22 computes a target value for the drive circuit 21 corresponding to the target rocking motion for the seat 1 on the basis of the fluctuating rocking motion Yj and enters it into the drive circuit 21.

Finally, in step ST5, the drive circuit 21 drives and energizes the solenoid 7 in a controlled manner according to the target value from the 1/f spectrum fluctuation computing circuit 22. The magnetic member 4 (magnetic elements 4*a*, 4*b*) attached and united to the seat 1 is then mutually attracted magnetically towards the solenoid 7 in a controlled manner.

The seat 1 is thus rocked and swayed with a fluctuation according to the fluctuating target value from the 1/f spectrum fluctuation computing circuit 22 in the rocking control circuit 20. As a result, an infant on the seat 1 will be given accelerations by a fluctuating rocking motion as if it is swayed in its mother's arms and will thus experience a feeling of comfort.

Steps ST3 to ST5 mentioned above may be allowed to continue over and again until the operating time of the rocking seat control apparatus 10 terminates. And, in step ST6, the operation ends when the operating time terminates.

A mention is next made of an operation of the rocking control apparatus 10 in a constant rocking mode where the switching circuit 25 in the rocking seat control circuit 20 connects the target rocking motion input section 24 to the drive circuit 21. The rocking control apparatus 10 in such a constant rocking mode operates as stated below.

The target rocking motion input section 24 entered with a preselected, constant target rocking motion furnishes the drive circuit 21 with a constant target value corresponding to the entered target rocking motion.

The drive circuit 21 drives and energizes the solenoid 7 in a controlled manner in accordance with the constant target value from the target rocking motion input section 24. The magnetic member 4 (magnetic elements 4*a*, 4*b*) attached and united to the seat 1 is then mutually attracted magnetically towards the solenoid 7 in such a controlled manner. The seat 1 is thus rocked and swayed with the preselected, constant rocking motion in accordance with the constant target value from the target rocking motion input section 24 in the rocking control circuit 20. As a result, an infant on the seat 1 will be given accelerations by a rocking motion of a fixed rocking movement without suffering any uncontrolled fluctuation.

According to a rocking seat control apparatus of the present invention in its second form of embodiment mentioned above, operating a drive circuit 21 in accordance with a fluctuating target value from a 1/f spectrum fluctuation computing circuit 22 to drive a solenoid 7 so as to bring about a desired target motion allows the seat 1 to be rocked and swayed by mutual magnetic actions between a magnetic member 4 and the solenoid 7. The rocking motion of the seat 1 is then caused to fluctuate moderately in accordance with a 1/f spectrum fluctuation. As a result, while the seat 1 is rocked and swayed so moderately as if it is rocked and swayed in human arms, an infant on the seat 1 will have moderate and comfortable accelerations and will thus will experience a feeling of comfort and peace of mind.

While in the second form of embodiment of the present invention, the drive circuit 21 and the 1/f spectrum fluctuation computing apparatus 22 have been shown as made separate from each other, may be made together, e.g., with a microcomputer.

Although the present invention has been described in terms of the presently preferred implementations of a rocking seat control apparatus as applied to an automatic rocking chair especially constructed as an infant chair, it is to be understood that such disclosure is purely illustrative and is not to be interpreted as limiting. In fact, a rocking seat control apparatus of the present invention shown and described hereinbefore may be applied to an automatic rocking chair constructed otherwise. Consequently, without departing from the spirit and scope of the present invention, various alterations, modifications, and/or alternative applications of the present invention will, no doubt, be suggested to those skilled in the art after having read the preceding disclosure. Accordingly, it is intended that the following claims be interpreted as encompassing all alterations, modifications, or alternative applications fall within the true spirit and scope of the present invention.

What is claimed is:

1. A rocking seat control apparatus, which comprises:

a moveable seat supported and having a magnetic member attached thereto;

a solenoid means for bi-directionally attracting said magnetic member repetitively to cause the seat to move in a positive direction and a negative direction alternately and thereby to be rocked;

an amplitude measuring means for measuring an amplitude of the seat being rocked and a rocking motion of the seat;

an amplitude damping factor measuring means responsive to displacements in the positive and negative directions of the seat for measuring a damping factor of said amplitude; and a solenoid energizing means for energizing said solenoid means for a time period in which the seat travels a distance corresponding to the amplitude multiplied by the damping factor.

2. A rocking seat control apparatus as set forth in claim 1, wherein said magnetic member comprises a pair of magnetic sub-members attached to the seat and whose mid point is positioned displaced from a mid point of said solenoid means by a predetermined distance.

3. A rocking seat control apparatus as set forth in claim 1 or 2, which further comprises:

a first light emitter disposed below a path of the seat being rocked;

a second light emitter united to said first light emitter;

a first light reflector including a plurality of light reflector plates attached to the seat as arranged in a row and spaced apart from one another across a predetermined spacing in a first direction in which the seat is rocked for reflecting light emitted from said first light emitter;

a second light reflector including a plurality of light reflector plates attached to the seat as arranged in a row and spaced apart from one another across a predetermined spacing in a second direction parallel to said first direction for reflecting light emitted from said second light emitter, said light reflector plates of the first light reflector being deviated in position from said light reflector plates of the second light reflector by half a width of each of said light reflector plates of the first light reflector;

a first light receiver mounted united to said first light emitter for receiving light reflected back from said first light reflector;

a second light receiver mounted united to said second light emitter for receiving light reflected back from said second light reflector;

a change of rocking direction detecting means responsive to a light receiving pattern of said first and second light receivers for detecting a reverse motion of the seat being rocked; and a seat amplitude measuring means responsive to numbers of light reception signals issued by said first and second light receivers for measuring an amplitude of the seat.

4. A rocking seat control apparatus as set forth in claim 3, wherein said light reflector plates of first light reflector and those of second light reflector are equal in width and spacing to each other, and the spacing across which successive light reflector plates of each of said first and second light reflectors are spaced apart is equal to the width of each of the reflector plates of said first and second light reflectors.

5. A rocking seat control apparatus, which comprises:

a moveable seat having a magnetic member;

a solenoid means energizable to bi-directionally attract said magnetic member repetitively, thereby rocking the seat;

a drive circuit for drivingly energize said solenoid means; and a 1/f spectrum fluctuation computing circuit adapted to compute a target value corresponding to a target rocking motion of the seat in a mode of 1/f-type spectrum fluctuation and to enter said target value into said drive circuit.

6. A rocking seat control apparatus as set forth in claim 5, wherein said 1/f-type spectrum fluctuation computing circuit includes an initial value input means adapted to be entered with initial values of said 1/f-type spectrum fluctuation.

7. A rocking seat control apparatus, which comprises:

a moveable seat having a magnetic member;

a solenoid means energizable to bi-directionally attract said magnetic member repetitively, thereby rocking the seat;

a drive circuit for drivingly energizing solenoid means;

a 1/f spectrum fluctuation computing circuit adapted to compute a target value corresponding to a target rocking motion of the seat in a mode of 1/f-type spectrum fluctuation and to enter said target value into said drive circuit; and a target rocking motion input means for producing a target value corresponding to a target rocking motion; and a switching means for selectively connecting one of said 1/f-type spectrum fluctuation computing circuit and said target rocking swing input means to said drive circuit.

8. A rocking seat control apparatus, which comprises:

a moveable seat having a magnetic member;

a solenoid means energizable to bi-directionally attract said magnetic member repetitively, thereby rocking the seat;

a drive circuit for drivingly energizing solenoid means;

a 1/f spectrum fluctuation computing circuit adapted to compute a target value corresponding to a target rocking motion of the seat in a mode of 1/f-type spectrum fluctuation and to enter said target value into said drive circuit; and a target rocking motion input means for producing a target value corresponding to a target rocking motion; and a switching means for selectively connecting one of said 1/f-type spectrum fluctuation computing circuit and said target rocking swing input means to said drive circuit, wherein said 1/f-type spectrum fluctuation computing circuit includes an initial value input means adapted to be entered with initial values of said 1/f-type spectrum fluctuation.

9. A rocking seat control apparatus as in any one of claims 5, 7 or 8, wherein said moveable seat comprises:

a seat;

a fixed frame supporting the seat via a coupling rod, in a manner capable to rock and sway the seat;

an attachment frame provided on the seat;

a rod provided on the attachment frame, having the magnetic member; and wherein the solenoid means is fixed on the fixed frame such that the rod penetrates the solenoid means.

* * * * *